US005195553A

United States Patent [19]

Wright

[11] Patent Number: 5,195,553

[45] Date of Patent: Mar. 23, 1993

[54] SPACER FOR MOUNTING PLUMBING TO A WALL

[75] Inventor: John C. Wright, Carmel, Ind.

[73] Assignee: Masco Corporation of Indiana, Taylor, Mich.

[21] Appl. No.: 822,023

[22] Filed: Jan. 15, 1992

[51] Int. Cl.[5] ..... F16L 5/00

[52] U.S. Cl. ..... 137/359; 137/360; 248/74.2

[58] Field of Search ..... 137/360, 359; 248/74.2

[56] References Cited

U.S. PATENT DOCUMENTS 2,166,916 7/1939 Lombard ..... 248/74.2
4,614,321 9/1986 Andre ..... 248/74.2

FOREIGN PATENT DOCUMENTS 2914431 4/1980 Fed. Rep. of Germany ..... 248/74.2
616212 1/1949 United Kingdom ..... 248/74.2

*Primary Examiner*—A. Michael Chambers
*Attorney, Agent, or Firm*—Myron B. Kapustij; Malcolm Sutherland

[57] ABSTRACT

A spacer for rigidly securing plumbing pipes to a wall. The spacer comprises a back portion comprised of a generally C-shaped clamp adapted to snap-fit over a plumbing pipe and a front portion including a flat face adapted to abut against the hidden or back surface of the wall.

4 Claims, 3 Drawing Sheets

SPACER FOR MOUNTING PLUMBING TO A WALL

FIELD OF THE INVENTION

This invention relates to a combination spacer/clamp for fixedly securing valves and their associated pipes to a wall.

BACKGROUND OF THE INVENTION

Generally in mounting a multi-valve plumbing assembly, such as one used for bathtubs, to a wall the vertical and horizontal piping is disposed between the supporting wall studs. A horizontal wood cross-piece is then attached to the vertical studs between which the piping is disposed. The piping is then secured, as by bent nails, wire, etc., to this cross-piece. The piping being thus secured the valves, which extend through holes in the wall, are also secured at a fixed distance relative to the front face of the wall.

However, this procedure requires additional time, effort and materials and is somewhat cumbersome. What is needed is a relatively quick and easy method of fixedly securing a valve assembly and its associated plumbing to a wall. The instant invention provides such a method and article.

SUMMARY OF THE INVENTION

The instant invention is directed to a spacer adapted to, in conjunction with an escutcheon, fixedly secure a valve assembly and its associated plumbing to a wall. The spacer comprises a rear portion which is in the form of a C-shaped clamp adapted to snap-fit onto the horizontal cold and hot water pipes of the associated plumbing, and a front portion including a flat face adapted to abut against the hidden or back surface of the wall. The wall is thus sandwiched between the front portion of the spacer and the escutcheon which abuts against the front or exposed surface of the wall. With the spacer abutting the wall the piping, onto which the spacer is snap-fit, is likewise fixedly secured against movement, particularly horizontal movement, relative to the wall.

DESCRIPTION OF THE DRAWINGS

FIG. 3 is a perspective partially exploded view of the spacer mounted on the horizontal pipes and abutting against a wall structure;

DESCRIPTION OF THE PREFERRED EMBODIMENT

Figure 1:
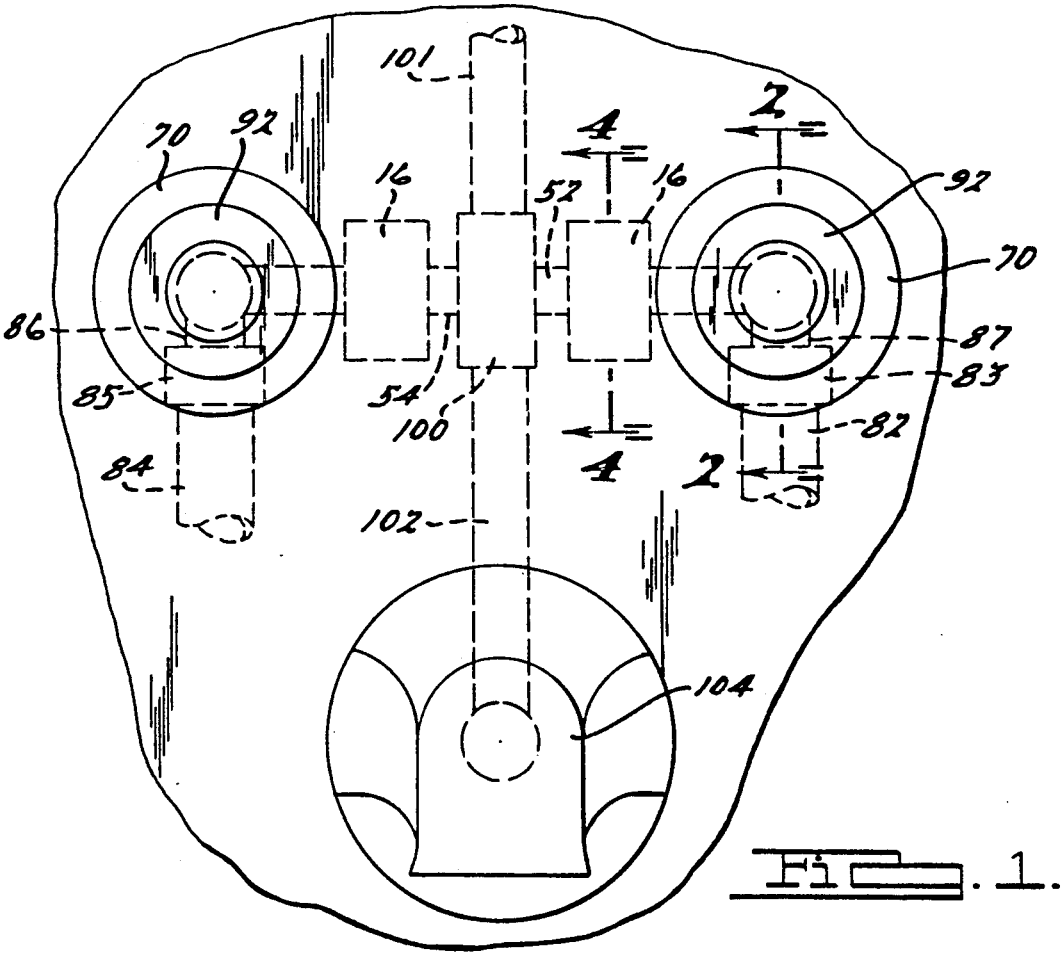
FIG. 1 is a front elevational view of the mounted spacer shown in conjunction with a portion of the wall structure and associated piping.
Figure 2:
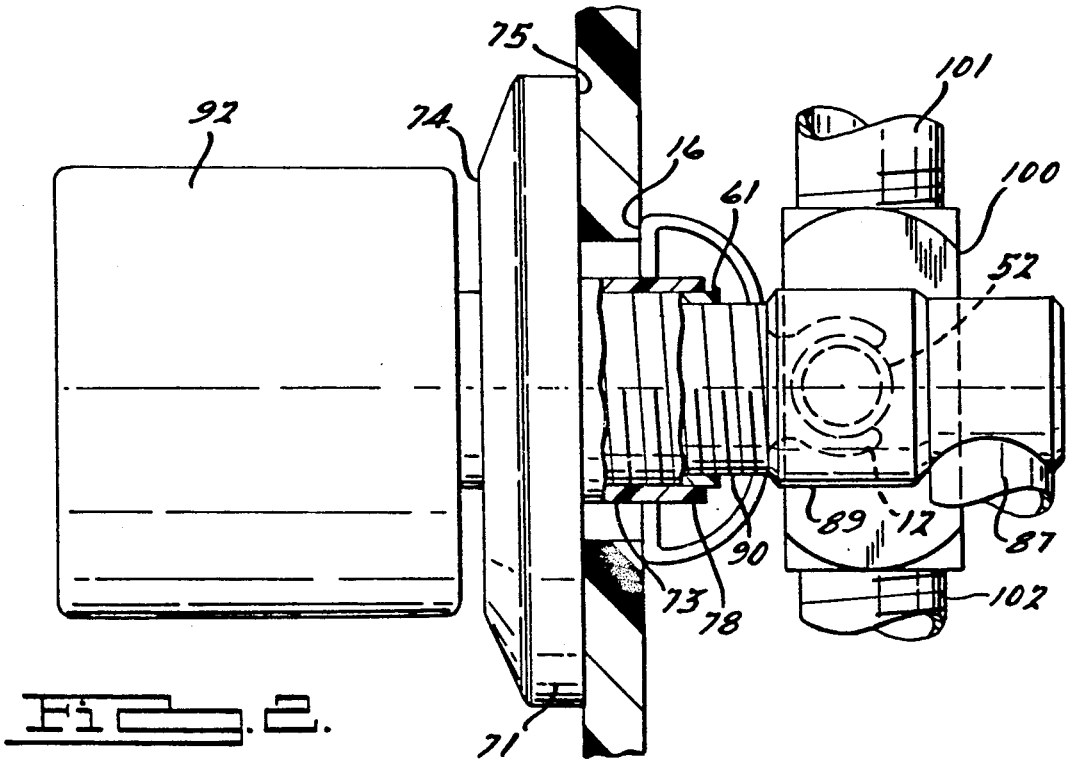
FIG. 2 is a partial sectional view taken along lines 2—2 in FIG. 1.
Figure 2:
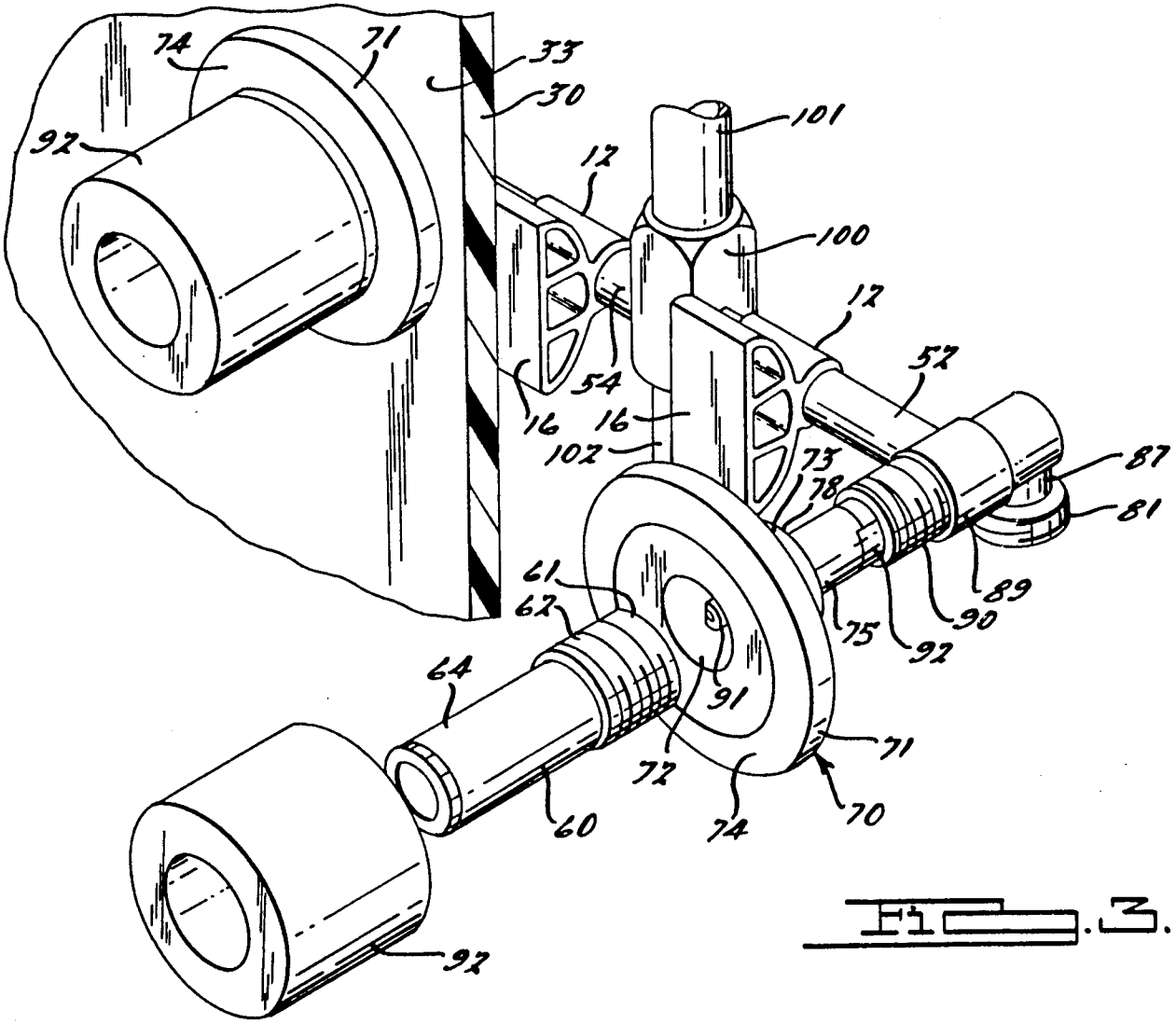
Figure 4:
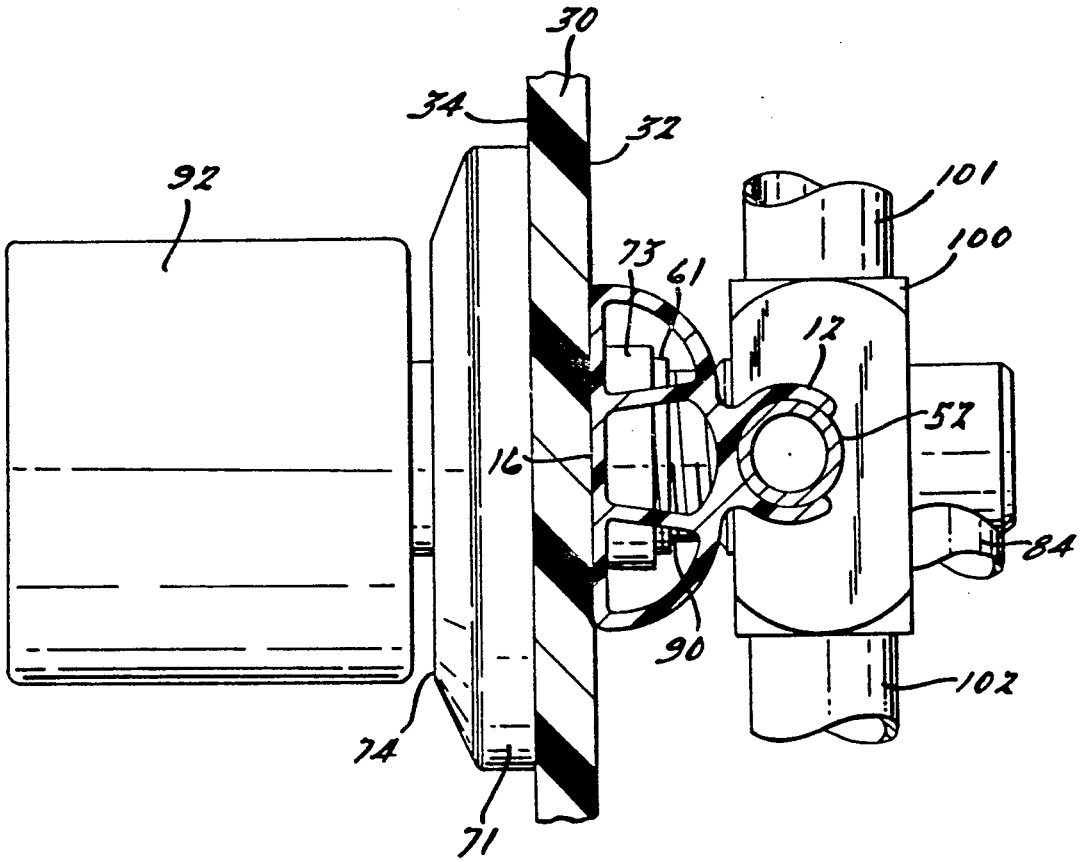
FIG. 4 is a view taken along lines 4—4 in FIG. 1.
Figure 5:
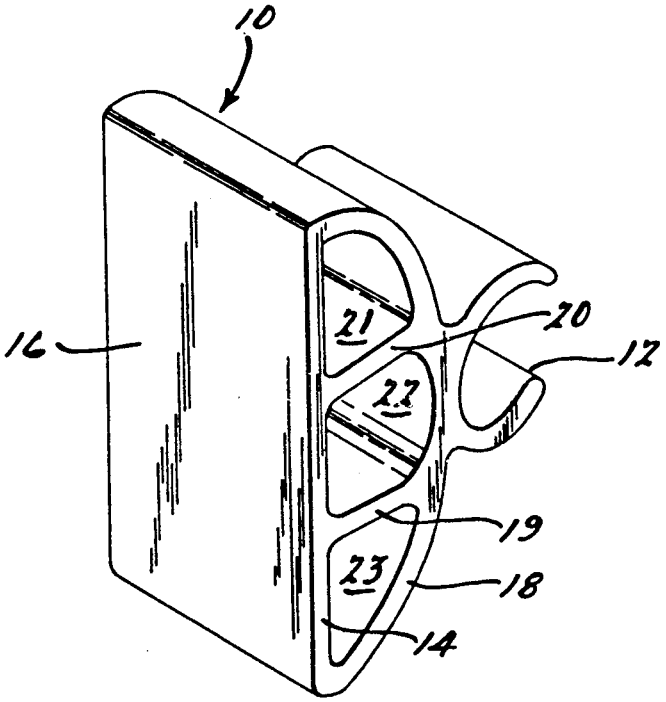
FIG. 5 is a perspective view of the spacer.

As best illustrated in FIG. 5 the spacer 10 comprises a longitudinally extending C-shaped clamping section 12 at its rear and a longitudinally extending abutment section 14 at its front opposite the clamping section 12. The abutment section 14 has a longitudinally extending generally rectangular shaped flat surface or face 16 which is adapted to abut against the inner or hidden surface 32 of wall 30 as best shown in FIG. 4. In the embodiment illustrated in the drawings the central section 18 of the spacer intermediate the flat face 16 and the C-shaped clamping section 12 is not solid but is comprised of horizontally extending ribs 20, 19 defining cavities 21, 22 and 23. It is to be understood that the central section 18 joining the abutment section 14 and the clamping section 12 may optionally be solid.

The C-shaped clamping section is sized to snap fit onto pipes 52, 54 of the plumbing.

The spacer 10 is comprised of a plastic material, preferably a material which is thermally stable at a temperature of about 180° F. (the maximum hot water temperature in the hot water pipe). Further, the plastic material should be resilient so that the C-shaped clamp section can be snap-fit over the pipe. An example of one such plastic is acrylonitrile-butadiene-styrene (ABS).

The associated plumbing includes a vertical hot water supply pipe 84 and a vertical cold water supply pipe 82. The hot water supply pipe 84 is connected at 85 to a hot water inlet pipe 86, while the cold water supply pipe 82 is connected at 83 to a cold water inlet pipe 87. The connected may be by means of threaded connections such as external threads 81 on the hot water inlet pipe 86 and cold water inlet pipe 87 and internal threads in the hot water supply pipe 84 and the cold water supply pipe 82, soldering, brazing, and the like. The hot water inlet pipe 86 is in communication with hot water valve housing (not shown) while cold water inlet pipe 87 is in communication with cold water valve housing 89. The hot water valve housing and cold water valve housing 89 have forward extending portions 90 which are externally threaded. Conventional and well known valves 92 are mounted in the cold water valve housing 89 and hot water valve housing. These valves include forwardly projecting valve stems 91 or valve stem extensions adapted to receive at their forward exposed ends operating handles 92 by means of which the valves may be operated.

The cold water valve controls the flow of cold water into horizontal cold water pipes 52 while the hot water valve controls the flow of hot water into horizontal hot water pipe 54. Horizontal cold water pipe 52 and horizontal hot water pipe 54 are joined, as by welding, brazing, soldering, etc., to center body 100.

Center body 100 is hollow and functions, inter alia, as a mixing chamber for the hot and cold water entering said center body 100 through pipes 54 and 52. A shower riser pipe 101 is connected at one end to center body 100 and at its other end to a shower head (not shown). Spout pipe 102 is connected at one end to center body 100 and terminates at its other end at spout 104.

Pipes 101 and 102 may be connected to center body 100 by any conventional means such as soldering, brazing, welding, threading, etc. In the preferred embodiment pipes 101 and 102 are threadedly attached to center body 100. A preferred threaded connection is accomplished by providing external threaded end portions on pipe 101 and 102 which threadedly engage internal threaded top and bottom portions of center body 100.

A conventional and well known diverter valve may be mounted in or adjacent the spout for directing the flow of water to either the spout or the shower head.

In another preferred embodiment a well known and conventional ejector may be disposed in the center body which prevents water from entering the shower riser pipe 101 unless the diverter valve is in a shower-on position.

Hollow tubular collars 60 having smooth front portions 64 and rear portions 61 which contain external threads 62 and internal threads (not shown) are mounted, by means of the internal threads, onto the externally threaded ends 90 of valve casings 89. The smooth front portions 64 of the collars 60 protrude through holes in wall 30 beyond the front face or surface 33 of wall 30.

The smooth front portions 64 of collars 60 extend through hollow tubular hubs 73 of the escutcheons 70. Hubs 73 extend rearwardly from the front faces 74 of escutcheons 70 and have internally threaded rear portions 78. Escutcheons 70 are threadedly mounted on the externally threaded rear portions 61 of the collars 60 by means of the internally threaded rear portions 78 of hubs 73 so that the rear edges 75 of skirts 71, which skirts project rearwardly from front faces 74, abut against the front surface 33 of wall 30. The wall is thus sandwiched or clamped between the rear edges of the skirts 71 of escutcheons 70 and the front flat surfaces 16 of abutment sections 14 of spacers 10.

In installation the spacers 10 are snap-fit onto pipes 52 and 54. Collars 60 are then threaded onto the first threaded portions 90 of valve housing 89. The escutcheons 70 are then screwed onto the threaded rear portions 62 of collars 60, and tightened until the front flat surfaces 16 of the spacers abut the rear surface of wall 30 while the rear edges 75 of skirts 71 abut the front surface of wall 30.

The holes in wall 30, which is preferably made of a thin synthetic material such as fiberglass, through which hubs 73 extend are sized to be sufficiently large so as to allow easy passage of hubs 73 therethrough, but small enough to be completely covered by escutcheons 70.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

I claim:

1. A plastic spacer for rigidly securing plumbing pipe to the hidden or back side of a wall in combination with an escutcheon disposed on the front or exposed side of said wall comprising a back portion comprised of a generally C-shaped clamping section adapted to snap-fit over a plumbing pipe and a front portion comprised of an abutting section containing a generally flat face adapted to abut against the hidden surface of said wall.

2. The spacer of claim 1 wherein said C-shaped clamp is longitudinally extending.

3. The spacer of claim 2 wherein said flat face is polygonal in shape.

4. The spacer of claim 2 wherein said flat face is rectangular in shape.

* * * * *